US005701975A

United States Patent [19]

Hawryszkow

[11] Patent Number: 5,701,975

[45] Date of Patent: Dec. 30, 1997

[54] RAILWAY VEHICLE BRAKE SYSTEM

[75] Inventor: Michael G. Hawryszkow, Munster, Ind.

[73] Assignee: Westinghouse Air Brake Company, Wilmerding, Pa.

[21] Appl. No.: 664,392

[22] Filed: Jun. 14, 1996

[51] Int. Cl.[6] ..... B60T 11/10

[52] U.S. Cl. ..... 188/52; 188/153 R

[58] Field of Search ..... 188/52, 53, 54, 188/55, 153 R, 153 D, 107, 198, 199, 203, 202, 1.11, 207, 209, 210, 206 R, 205 R

[56] References Cited

U.S. PATENT DOCUMENTS

| | | | |
|---|---|---|---|
| 3,893,544 | 7/1975 | Means | 188/52 |
| 4,175,793 | 11/1979 | Clemmons | 188/153 R |
| 4,201,277 | 5/1980 | Meier et al. | 188/153 R |
| 4,312,428 | 1/1982 | Beacon | 188/52 |
| 4,544,047 | 10/1985 | Clemmons et al. . | |
| 4,766,980 | 8/1988 | Engle | 188/206 R |
| 5,507,368 | 4/1996 | Barefoot | 188/198 X |

*Primary Examiner*—Douglas C. Butler
*Attorney, Agent, or Firm*—James Ray & Associates

[57] ABSTRACT

A railway car system includes at least one reservoir containing a predetermined volume of a fluid type media. At least one cylinder is activated in a first direction by such fluid type media and is spring released in an axially opposed second direction. At least one fluid media type pump is connected for fluid communication between such at least one reservoir and such at least one cylinder. Such pump being connected to receive the fluid type media from such at least one reservoir via a first fluid supply line and to communicate such fluid type media to such at least one cylinder during a parking brake application via a second fluid supply line and to return such fluid type media from such at least one cylinder via such second fluid supply line to such at least one reservoir via such first fluid supply line when such parking brake is released. A pump activation device is connected to such at least one pump for initiating communication of such fluid type media. An adapter is secured to a first end of such at least one cylinder for enabling such parking brake system to be engaged with different brake beam configurations used in freight car braking systems. There is a jaw-like member connected to an axially opposed second end of such at least one cylinder for transmitting a force to a brake beam carrying a pair of brake shoes thereon which are frictionally engaged with a predetermined portion of the tread surface of a respective wheel.

20 Claims, 2 Drawing Sheets

RAILWAY VEHICLE BRAKE SYSTEM

CROSS REFERENCE TO RELATED APPLICATIONS

The invention taught in the present application is closely related to co-pending and concurrently filed patent application titled, "PNEUMATIC PRESSURE OPERATED PARKING BRAKE FOR A RAILWAY VEHICLE BRAKE SYSTEM" filed on Jun. 14, 1996 and assigned Ser. No. 08/664,391 and "A BLACK ADJUSTABLE FORCE TRANSMITTING CYLINDER" filed on Jun. 14, 1996 and assigned Ser. No. 08/664,389. These co-pending and concurrently filed applications are, also, assigned to the assignee of the present invention. In addition, the teachings in these co-pending and concurrently filed applications are incorporated herein by reference thereto.

FIELD OF THE INVENTION

The present invention relates, in general, to various types of railway vehicle braking systems and, more particularly, the invention relates to an improved brake system for a railway type freight car and, still more particularly, the instant invention relates to a brake system having an improved parking brake type system for use on such railway type freight cars incorporated therein.

BACKGROUND OF THE INVENTION

Prior to the conception and subsequent development of the present invention, as is generally quite well known in the railroad industry, railway type freight cars are required to be equipped with a parking brake as a part of the necessary braking system disposed on such freight cars. These prior art parking brakes have to be set manually, at least, when the brake pipe air line disposed on such freight cars is not connected for fluid communication with the brake pipe air line of the air brake system disposed on a train consist. This would be the case, for example, when such freight car is either waiting to be connected into such train consist or when such freight car has been removed from such train consist.

The parking brakes being used in this application, for many years prior to the present invention, have all required that they be both manually applied and thereafter released by railroad personnel. Such manual application and subsequent release of these hand brakes has required these prior art type parking brakes to be equipped with either a hand wheel member or a hand crank. Normally, either through the rotation of such hand wheel member or by pumping on the hand crank the required amount of brake force can be generated and applied to the brake beam or beams carrying the brake shoes which are frictionally engaged with at least a portion of the tread surface of the respective wheels disposed on the truck portion of a freight car.

Such required braking force is applied to the brake beams and then to the brake shoes through a chain connected at a first end thereof to a chain drum disposed in the hand brake and then connected at a second end thereof to the brake beams, carrying such brake shoes, through a brake lever system. Such chain drum being rotated thorough the manual operation of the hand wheel or hand crank. These prior art type parking brake systems are quite well known in the railway braking art and, therefore, a further more detailed description of them here is believed to be unnecessary.

SUMMARY OF THE INVENTION

The present invention, according to a first aspect thereof, provides a reliable and improved railway freight car type parking brake system. This parking brake system includes at least one reservoir engageable on such freight car for retaining therein a predetermined volume of a predetermined type fluid media therein. There is at least one cylinder which is activated in a piston extending first direction by such type fluid media, during a parking brake application, and which is spring released in an axially opposed piston retraction second direction, when such parking brake is released. At least one fluid media type pump means is connected for fluid communication between such at least one reservoir and such at least one cylinder. The fluid media type pump means is connected to receive the predetermined type fluid media from such at least one reservoir via a first fluid supply line and to communicate this predetermined type fluid media to such at least one cylinder during a parking brake application via a second fluid supply line. Such fluid media type pump means will, also, allow return of such predetermined type fluid media from such at least one cylinder via the second fluid supply line to the at least one reservoir via such first fluid supply line when the parking brake is released. There is a pump activation means connected to such at least one fluid media type pump means for initiating the communication of such predetermined type fluid media. In addition, an adapter means is secured at a first end thereof to a first predetermined end of such at least one cylinder. This adapter means enables this improved parking brake system to be adapted for engagement with a number of different type brake beam configurations which are presently being used in railway freight car type braking systems. The final essential component of the improved parking brake system, according to this embodiment of the invention, is at least one jaw-like member connected at one end thereof to an axially opposed second end of such at least one cylinder. Such at least one jaw-like member transmits a predetermined force to a brake beam carrying brake shoes thereon which are frictionally engaged with a portion of the tread surface of a respective wheel.

In a second embodiment, which may be preferred in a number of applications, the present invention also provides a reliable and improved railway freight car type parking brake system. In this second embodiment such parking brake system includes an at least one reservoir which is adapted to be engageable on such railway freight car. The at least one reservoir contains a predetermined volume of a predetermined type fluid media therein. A first force transmitting cylinder means is activated in a first direction by such predetermined type fluid media, for a parking brake application, and is released by a spring in an axially opposed second direction, when such parking brake is to be released. Additionally, there is a second force transmitting cylinder means provided which is likewise activated in a first direction by such fluid media and is also spring released in an axially opposed second direction. The parking brake system, according to this embodiment, includes a pair of fluid media type pump means. A first one of such pair of fluid media type pump means is connected for fluid communication between the at least one reservoir and at least with such first force transmitting cylinder means. In addition, this first one of such pair of fluid media type pump means is connected to receive such predetermined type fluid media from such at least one reservoir via a first fluid supply line and to communicate this predetermined type fluid media to at least such first force transmitting cylinder means, during a parking brake application, via a second fluid supply line and to return such predetermined type fluid media from such first force transmitting cylinder means via such second fluid supply line to the at least one reservoir via the first fluid supply line, when such parking brake is released. The second one of such pair of fluid media type pump means is connected for fluid communication between such at least one reservoir and such second force transmitting cylinder means. The second one of such pair of fluid media type pump means being further connected to receive the predetermined type fluid media from such at least one reservoir via a third fluid supply line and to communicate this predetermined type fluid media to such second force transmitting cylinder means, during a parking brake application, via a fourth fluid supply line and to return such predetermined type fluid media from the second force transmitting cylinder means via such fourth fluid supply line to such at least one reservoir via the second fluid supply line, when such parking brake is released. There is a pair of pump activation means provided. The first one of such pair of pump activation means is connected to such first one of the fluid media type pump means for initiating communication of such predetermined type fluid media and a second one of such pair of such pump activation means is connected to the second one of such fluid media type pump means for initiating communication of such predetermined type fluid media. The parking brake system, of this embodiment, further provides a pair of adapter means. The first one of such pair of adapter means is secured to a first predetermined end of such first force transmitting cylinder means and a second one of such pair of adapter means is secured to a first predetermined end of the second force transmitting cylinder means for enabling such improved parking brake system to be adapted for engagement with different types of brake beam configurations which are presently being used in railway freight car type braking systems. Finally, there is provided, in this embodiment of the improved parking brake system, a pair of jaw-like members. The first one of such pair of jaw-like members is connected at one end thereof to an axially opposed second end of such first force transmitting cylinder means and a second one of such pair of jaw-like members is connected at one end thereof to an axially opposed second end of the second force transmitting cylinder means for transmitting a predetermined brake force to the brake beams carrying brake shoes thereon which are pressed into frictional engagement with at least a portion of the tread surface of a respective wheel disposed on the truck portion of such freight car.

OBJECTS OF THE INVENTION

It is, therefore, one of the primary objects of the present invention to provide an improved railway vehicle type parking brake system which does not require either a hand wheel member or a hand crank member to be utilized in order to apply and/or release such parking brake system.

Another object of the present invention is to provide an improved railway vehicle type parking brake system which, in addition to being utilized in new railway vehicle construction, can be readily and easily retrofitted onto existing railway type freight cars to provide enhanced performance of the parking brake system.

Still another object of the present invention is to provide an improved railway vehicle type parking brake system which can effectively incorporate the use of both pneumatic and hydraulic pressure therein.

Yet another object of the present invention is to provide an improved railway vehicle type parking brake system which can be specifically designed to be applied and/or released from either side or both sides of such railway vehicle.

A further object of the present invention is to provide an improved railway vehicle type parking brake system which can be adapted to the numerous different style brake beams which are being used to carry the brake shoes, at the present time, in such railway vehicle type brake systems.

It is still an additional object of the present invention to provide an improved railway vehicle type parking brake system which can be applied with fluid pressure in a first direction and released by a spring in an axially opposed second direction.

Another object of the present invention is to provide an improved railway vehicle type parking brake system which may include at least one fail safe feature.

Still yet another object of the present invention is to provide an improved railway vehicle type parking brake system which will not interfere with the required normal operation of the railway vehicle's primary air brake system when such parking brake system is not in use.

Yet still another object of the present invention is to provide an improved railway vehicle type parking brake system which can be operated from either the ground level, from the vehicle itself, or from both the ground level and the vehicle itself.

It is a still further object of the present invention to provide an improved railway vehicle type parking brake system which is relatively simple to operate.

A further object of the present invention is to provide an improved railway vehicle type brake system which is relatively simple to install.

In addition to the several objects and advantages of the present invention that have been discussed in some detail above, various additional objects and advantages of the improved railway vehicle type parking brake system, according to the present invention, will become more readily apparent to those persons who are skilled in the railway vehicle braking art from the following more detailed description of the invention, particularly, when such detailed description is taken in conjunction with the attached drawing Figures and with the appended claims.

Figure 1:
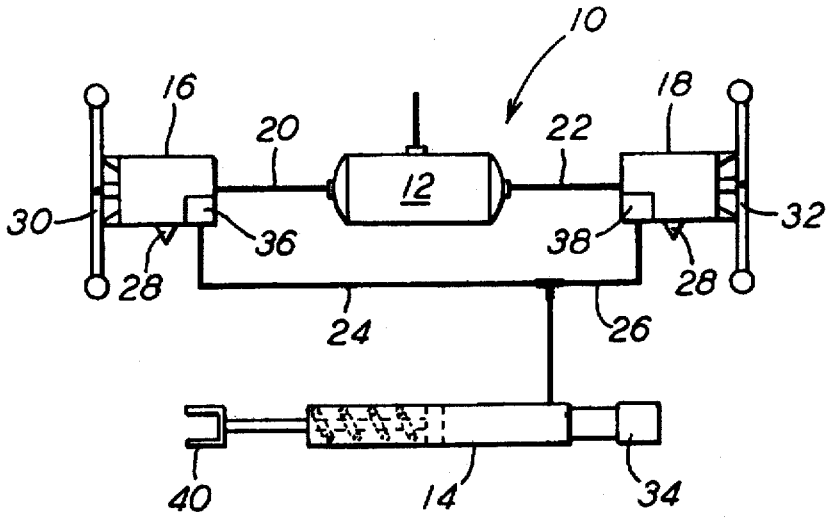
FIG. 1 is a schematic illustration of a first embodiment of an improved railway vehicle type parking brake system in accordance with the present invention.

BRIEF DESCRIPTION OF THE PRESENTLY PREFERRED AND VARIOUS ALTERNATIVE EMBODIMENTS OF THE INVENTION

Prior to proceeding to the more detailed description of the invention, it should be noted that, for the sake of clarity and understanding of the invention, identical components which have identical functions have been identified with identical reference numerals throughout the several views illustrated in the attached drawing Figures.

Reference is now made, more particularly, to FIG. 1 of the attached drawings. Illustrated therein is one embodiment of the improved railway freight car type parking brake system, generally designated 10. Such improved railway freight car type parking brake system 10 includes at least one reservoir 12 for containing a predetermined volume of a predetermined fluid type media. Such at least one reservoir 12 can be secured to the freight car (not shown) at any convenient location.

In the presently preferred embodiment of the improved railway freight car type parking brake system 10, illustrated in FIG. 1, such at least one reservoir 12 will be sized to contain generally between about 20.0 cubic inches and about 200.0 cubic inches of such predetermined fluid type media therein. The presently preferred predetermined fluid type media is a hydraulic fluid.

The parking brake system 10, as shown, includes at least one cylinder 14. Such at least one cylinder 14 is activated in a first direction by such fluid type media and is spring released in an axially opposed second direction. In view of the predetermined fluid type media preferably being hydraulic fluid, such at least one cylinder 14 will, accordingly, be a hydraulic cylinder.

Additionally, there is at least one fluid media type pump means 16 connected for fluid communication between such at least one reservoir 12 and such at least one cylinder 14. Two such fluid media type pump means 16 and 18 have been illustrated in FIG. 1.

In the embodiment of the invention illustrated in FIG. 1, of the improved railway freight car type parking brake system 10, such at least one fluid media type pump means 16 includes a gradual release valve means 36. Such gradual release valve means 36 controls the flow of such predetermined fluid type media. Preferably, each of such fluid media type pump means 16 and 18 will be equipped with a gradual release valve means 36 and 38, respectively.

The fluid media type pump means 16 and 18 are connected to receive the predetermined fluid type media from such at least one reservoir 12 via a, respective, first fluid supply line 20 and 22 to communicate such predetermined fluid type media to such at least one cylinder 14 during a parking brake application via a, respective, second fluid supply line 24 and 26 and to return this predetermined fluid media from the at least one cylinder 14 via such second fluid supply line 24 and 26 to the at least one reservoir 12 via the first fluid supply line 20 and 22 when such parking brake 10 is released.

Such at least one fluid media type pump means 16, as shown in FIG. 1, will preferably include an indicator means 28. Such indicator means 28 being provided to indicate at least one of either an application position or a release position of such parking brake 10.

There is a pump activation means 30 connected to such at least one fluid media type pump means 16. As illustrated in FIG. 1, preferably, there is another pump activation means 32 connected to fluid media type pump means 18. Such pump activation means 30 and 32 initiate communication of such predetermined fluid type media.

It is presently preferred that in the improved railway freight car type parking brake system 10, as illustrated in FIG. 1, such pump activation means 30 includes a means 40 for enabling such pump activation means 30 to be operated from at least one of ground level and from a position disposed on such freight car.

An adapter means 34 is secured to a first predetermined end of such at least one cylinder 14. Such adapter means 34 enables the improved parking brake system 10 to be adapted for engagement with a number of different type brake beam configurations which are presently being used in railway freight car type braking systems (not shown). Such adapter means 34 is secured to a first brake beam (not shown in the FIG. 1 embodiment) disposed on a first side of a railway freight car truck member (not shown).

The final essential component of the improved parking brake system 10, as illustrated in FIG. 1, is a jaw-like member 40 connected at one end thereof to an axially opposed second end of such at least one cylinder 14 for transmitting a predetermined force to a brake beam carrying brake shoes thereon. Such brake shoes being frictionally engaged with a predetermined portion of a tread surface of a respective wheel. It should also be noted that such jaw-like member 40 is, preferably, adapted to engage such brake beam in a sliding manner so as not to interfere with the necessary and normal operation of the brake beam.

This jaw-like member 40 is adapted to engage a radially opposed second brake beam (also not shown in the FIG. 1 embodiment) disposed on a radially opposed second side of such railway freight car truck member.

Figure 2:
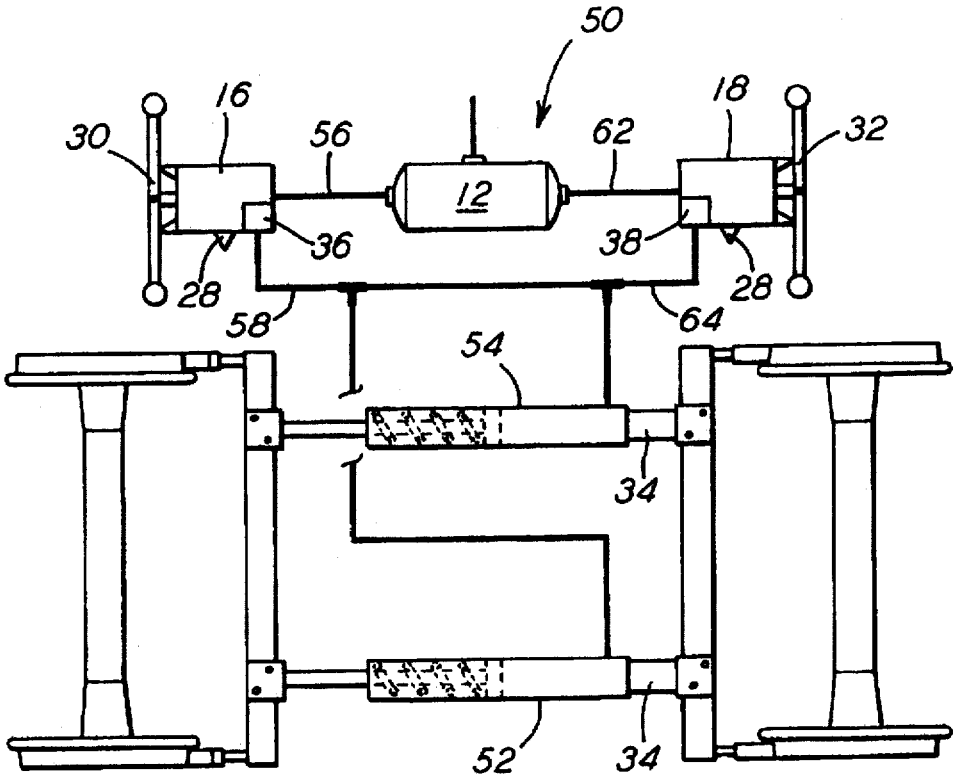
FIG. 2 is a schematic illustration of an alternative second embodiment of an improved railway vehicle type parking brake system in accordance with the present invention, which in certain vehicle applications may be the presently preferred embodiment.

Now reference is made, more particularly, to FIG. 2. Illustrated therein is a presently preferred embodiment of an improved railway freight car type parking brake system, generally designated 50.

This parking brake system 50, also, includes an at least one reservoir means 12 which is engageable with such railway freight car for containing the predetermined volume of such predetermined fluid type media therein.

In this embodiment, like the embodiment illustrated in FIG. 1, such at least one reservoir 12 will, preferably, be sized to contain a volume of generally between about 20.0 cubic inches and about 200.0 cubic inches of such predetermined fluid type media therein. Furthermore, such predetermined fluid type media is a hydraulic fluid in this embodiment of the present invention.

The brake system 50 includes a first force transmitting cylinder means 52 engageable on a first portion of a truck member (not shown) of such railway freight car. Such first force transmitting cylinder means 52 exerts a first predetermined force in a brake applying first direction. This first force transmitting cylinder means 52 is activated in such brake applying first direction by such fluid type media and is spring released in an axially opposed brake release second direction.

There is a second force transmitting cylinder means 54 provided which is engageable on a second portion of such truck member of such railway freight car for exerting a second predetermined force in such brake applying first direction. This second force transmitting cylinder means 54 is, also, activated in such brake applying first direction by the fluid type media and spring released in such axially opposed brake release second direction.

In this embodiment of the present invention, as in the above described embodiment, at least one of such first force transmitting cylinder means 52 and such second force transmitting means 54 may be a hydraulic cylinder. It is also within the scope of the present invention for such first force transmitting cylinder means 52 to be a hydraulic cylinder and such second force transmitting cylinder means 54 to, also, be a hydraulic cylinder.

Figure 3:
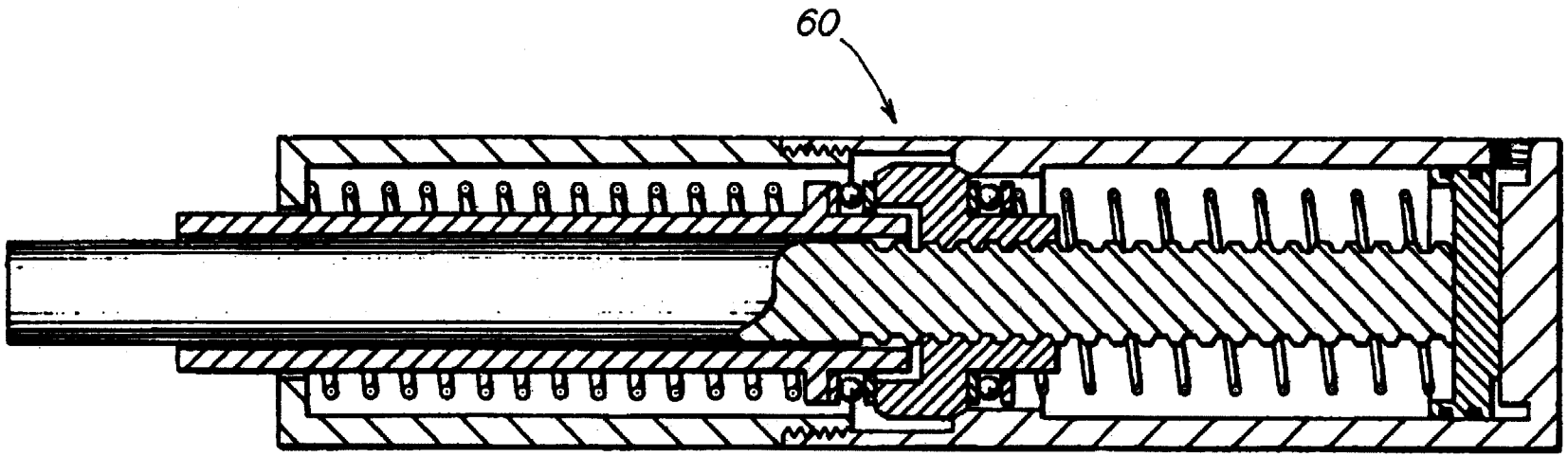
FIG. 3 is a cross sectional view of a presently preferred force transmitting cylinder means for use in such railway vehicle type parking brake system.

In certain applications for such improved railway freight car type parking brake system 10 it may be desirable for at least one of such first force transmitting cylinder means 52 and such second force transmitting cylinder means 54 to have a means, generally designated 60 in FIG. 3, for adjusting slack incorporated therein. It may be further desirable for each of such first force transmitting cylinder means 52 and such second force transmitting means 54 to include a means 60 incorporated therein for adjusting any slack that may be present in such parking brake system 10.

There is a pair of fluid media type pump means 16 and 18 provided in this embodiment of the invention. A first one 16 of such pair of fluid media type pump means 16 and 18 is connected for fluid communication between such at least one reservoir 12 and at least with the first force transmitting cylinder means 52. This first one 16 of such pair of fluid media type pump means 16 and 18 being further connected to receive such predetermined fluid type media from such at least one reservoir 12 via a first fluid supply line 56 and to communicate such predetermined fluid type media to at least the first force transmitting cylinder means 52, during a parking brake 50 application, via a second fluid supply line 58 and to return the predetermined fluid type media from such first force transmitting cylinder means 52 via the second fluid supply line 58 to the at least one reservoir 12 via such first fluid supply line 56, when such parking brake 50 is released.

A second one 18 of such pair of fluid media type pump means 16 and 18 is connected for fluid communication between such at least one reservoir 12 and at least such second force transmitting cylinder means 54. This second one 18 of such pair of fluid media type pump means 16 and 18 being further connected to receive the predetermined fluid type media from such at least one reservoir 12 via a third fluid supply line 62 and to communicate such predetermined fluid type media to at least such second force transmitting cylinder means 54, during a parking brake 50 application, via a fourth fluid supply line 64 and to return such predetermined fluid type media from such second force transmitting cylinder means 54 via such fourth fluid supply line 64 to the at least one reservoir 12 via such second fluid supply line 58, when the parking brake 50 is released.

In this embodiment of the invention, as was the case in the first embodiment, it is presently preferred that at least one of such pair of fluid media type pump means 16 and 18 includes a gradual release valve means 36 for controlling the flow of such predetermined fluid type media.

It is, also, presently preferred, in this embodiment of the invention, that at least one of such pair of such fluid media type pump means 16 and 18 includes an indicator means 28 for indicating an application and a release position of such parking brake 50.

The improved parking brake system 50, in this embodiment, includes a pair of pump activation means 30 and 32. The first one 30 of such pair of pump activation means 30 and 32 is connected to the first one 16 of such fluid media type pump means 16 and 18 for initiating communication of the predetermined fluid type media. The a second one 32 of such pair of pump activation means 30 and 32 is connected to the second one 18 of such fluid media type pump means 16 and 18 for initiating communication of such predetermined fluid type media.

In the presently preferred embodiment, of this improved railway freight car type parking brake system 50, at least one of such pair of pump activation means 16 and 18 will include a means 40 for enabling such at least one of such pair of pump activation means 16 and 18 to be operated from at least one of ground level and from a position disposed on such freight car.

It is even more preferred that each of such pair of pump activation means 16 and 18 includes a means 40 for enabling each one of such pair of pump activation means 16 and 18 to be operated from at least one of ground level and operated from a position disposed on such freight car.

The improved railway vehicle parking brake system 50 further includes a pair of adapter means 34. The first one of such pair of adapter means 34 being secured to a first predetermined end of the first force transmitting cylinder means 52 and a second one of such pair of adapter means 34 being secured to a first predetermined end of such second force transmitting cylinder means 54 for enabling such parking brake system 50 to be adapted for engagement with different type brake beam configurations used in railway freight car type braking systems.

The final essential component of the brake system 50 is a pair of jaw-like members 42. The first one of such pair of jaw-like members 42 is connected at one end thereof to an axially opposed second end of such first force transmitting cylinder means 52 and a second one of this pair of jaw-like members 42 is connected at one end thereof to an axially opposed second end of such second force transmitting cylinder means 54 for transmitting a predetermined force to a brake beam carrying brake shoes thereon which frictionally engage with a portion of a tread surface of a respective wheel.

While a presently preferred and a number of alternative embodiments of the present invention have been described in detail above, it should be understood that various additional adaptations and/or modifications to such invention can be made, particularly, by those persons who are skilled in the railway vehicle type braking systems art without departing from either the spirit of the instant invention or the scope of the appended claims.

I claim:

1. An improved railway freight car type parking brake system, said parking brake system comprising:

(a) at least one reservoir for containing a predetermined volume of a predetermined fluid type media;

(b) at least one cylinder activated in a first direction by said fluid type media, and spring released in an axially opposed second direction;

(c) at least one fluid media type pump means connected for fluid communication between said at least one reservoir and said at least one cylinder, said fluid media type pump means being further connected to receive said predetermined fluid type media from said at least one reservoir via a first fluid supply line and to communicate said predetermined fluid type media to said at least one cylinder during a parking brake application via a second fluid supply line and to return said predetermined fluid type media from said at least one cylinder via said second fluid supply line to said at least one reservoir via said first fluid supply line when said parking brake is released;

(d) pump activation means connected to said at least one fluid media type pump means for initiating communication of said predetermined fluid type media;

(e) an adapter means secured to a first predetermined end of said at least one cylinder for enabling said improved parking brake system to be adapted for engagement with different type brake beam configurations used in railway freight car type braking systems; and (f) a jaw-like member connected at one end thereof to an axially opposed second end of said at least one cylinder for transmitting a predetermined force to a brake beam carrying brake shoes thereon which frictionally engage with a portion of a tread surface of a respective wheel.

2. An improved railway freight car type parking brake system, according to claim 1, wherein said at least one reservoir is sized to contain generally between about 20.0 cubic inches and about 200.0 cubic inches of said predetermined fluid type media therein.

3. An improved railway freight car type parking brake system, according to claim 2, wherein said predetermined fluid type media is a hydraulic fluid.

4. An improved railway freight car type parking brake system, according to claim 3, wherein said at least one cylinder is a hydraulic cylinder.

5. An improved railway freight car type parking brake system, according to claim 1, wherein said at least one fluid media type pump means includes a gradual release valve means for controlling flow of said predetermined fluid type media during operation of said parking brake system.

6. An improved railway freight car type parking brake system, according to claim 5, wherein said at least one fluid media type pump means includes an indicator means for indicating an application and a release position of said parking brake system.

7. An improved railway freight car type parking brake system, according to claim 1, wherein said pump activation means includes a means for enabling said pump activation means to be operated from at least one of ground level and from a position disposed on such freight car.

8. An improved railway freight car type parking brake system, according to claim 1, wherein said adapter means is secured to a first brake beam disposed on a first side of a railway freight car truck member.

9. An improved railway freight car type parking brake system, according to claim 8, wherein said jaw-like member engages a radially opposed second brake beam disposed on a radially opposed second side of such railway freight car truck member.

10. An improved railway freight car type parking brake system, according to claim 1, wherein said parking brake system further includes:

(a) a pair of fluid media type pump means, each one of said pair of fluid media type pump means being connected for fluid communication between said at least one reservoir and said at least one cylinder, said each one of said pair of said fluid media type pump means being further connected to receive said predetermined fluid type media from said at least one reservoir via a first fluid supply line and to communicate said predetermined fluid type media to said at least one cylinder, during a parking brake application, via a second fluid supply line and to return said predetermined fluid type media from said at least one cylinder via said second fluid supply line to said at least one reservoir via said first fluid supply line, when said parking brake is released; and (b) a pair of pump activation means, a respective one of said pair of pump activation means being connected to a respective one of said pair of said fluid media type pump means for initiating communication of said predetermined fluid type media.

11. An improved railway freight car type parking brake system, said parking brake system comprising:

(a) at least one reservoir means engageable with such railway freight car for containing a predetermined volume of a predetermined fluid type media therein;

(b) a first force transmitting cylinder means engageable on a first portion of a truck member of such railway freight car for exerting a first predetermined force in a brake applying first direction, said first force transmitting cylinder means activated in said brake applying first direction by said fluid type media and spring released in an axially opposed brake release second direction;

(c) a second force transmitting cylinder means engageable on a second portion of such truck member of such railway freight car for exerting a second predetermined force in said brake applying first direction, said second force transmitting cylinder means activated in said brake applying first direction by said fluid type media and spring released in said axially opposed brake release second direction;

(d) a pair of fluid media type pump means, a first one of said pair of said fluid media type pump means connected for fluid communication between said at least one reservoir and at least with said first force transmitting cylinder means, said first one of said pair of said fluid media type pump means being further connected to receive said predetermined fluid type media from said at least one reservoir via a first fluid supply line and to communicate said predetermined fluid type media to said at least said first force transmitting cylinder means, during a parking brake application, via a second fluid supply line and to return said predetermined fluid type media from said at least said first force transmitting cylinder means via said second fluid supply line to said at least one reservoir via said first fluid supply line, when said parking brake is released, a second one of said pair of said fluid media type pump means connected for fluid communication between said at least one reservoir and at least said second force transmitting cylinder means, said second one of said pair of said fluid media type pump means being further connected to receive said predetermined fluid type media from said at least one reservoir via a third fluid supply line and to communicate said predetermined fluid type media to said at least said second force transmitting cylinder means, during a parking brake application, via a fourth fluid supply line and to return said predetermined fluid type media from said at least said second force transmitting cylinder means via said fourth fluid supply line to said at least one reservoir via said second fluid supply line when said parking brake is released;

(e) a pair of pump activation means, a first one of said pair of pump activation means connected to said first one of said fluid media type pump means for initiating communication of said predetermined fluid type media and a second one of said pair of said pump activation means connected to said second one of said fluid media type pump means for initiating communication of said predetermined fluid type media;

(f) a pair of adapter means, a first one of said pair of adapter means being secured to a first predetermined end of said first force transmitting cylinder means and a second one of said pair of adapter means being secured to a first predetermined end of said second force transmitting cylinder means for enabling said improved parking brake system to be adapted for engagement with a number of different type brake beam configurations used in railway freight car type braking systems; and (g) a pair of jaw-like members, a first one of said pair of said jaw-like members connected at one end thereof to an axially opposed second end of said first force transmitting cylinder means and a second one of said pair of said jaw-like members connected at one end thereof to an axially opposed second end of said second force transmitting cylinder means for transmitting a predetermined force to a brake beam carrying brake shoes thereon which frictionally engage with a portion of a tread surface of a respective wheel.

12. An improved railway freight car type parking brake system, according to claim 11, wherein at least one of said first force transmitting cylinder means and said second force transmitting means includes a means incorporated therein for adjusting slack present in said parking brake system.

13. An improved railway freight car type parking brake system, according to claim 12, wherein each of said first force transmitting cylinder means and said second force transmitting means includes a means incorporated therein for adjusting slack present in said parking brake system.

14. An improved railway freight car type parking brake system, according to claim 11, wherein at least one of said first force transmitting cylinder means and said second force transmitting means is a hydraulic cylinder.

15. An improved railway freight car type parking brake system, according to claim 11, wherein at least one of said pair of fluid media type pump means includes a gradual release valve means for controlling flow of said predetermined fluid type media.

16. An improved railway freight car type parking brake system, according to claim 11, wherein at least one of said pair of said fluid media type pump means includes an indicator means for indicating an application and a release position of said parking brake system.

17. An improved railway freight car type parking brake system, according to claim 11, wherein at least one of said pair of said pump activation means includes a means for enabling said at least one of said pair of said pump activation means to be operated from at least one of ground level and from a position disposed on such freight car.

18. An improved railway freight car type parking brake system, according to claim 17, wherein each one of said pair of said pump activation means includes a means for enabling said each one of said pair of said pump activation means to be operated from at least one of ground level and from a position disposed on such freight car.

19. An improved railway freight car type parking brake system, according to claim 11, wherein said at least one reservoir is sized to contain generally between about 20.0 cubic inches and about 200.0 cubic inches of said predetermined fluid type media therein.

20. An improved railway freight car type parking brake system, according to claim 19, wherein said predetermined fluid type media is a hydraulic fluid.

* * * * *

UNITED STATES PATENT AND TRADEMARK OFFICE

CERTIFICATE OF CORRECTION

PATENT NO. : 5,701,975

DATED : December 30, 1997

INVENTOR(S) : Michael G Hawryszkow

It is certified that error appears in the above-identified patent and that said Letters Patent is hereby corrected as shown below:

Line 1 of the abstract, after "car", please insert --parking brake--.

Column 1, line 10, after "A", please delete "BLACK" and insert --SLACK--;

column 1, line 59, after "rotated", please delete "thorough" and insert --through--.

Column 7, line 50, after "The", please delete "a".

Signed and Sealed this

Second Day of May, 2000

*Attest:*

*Attesting Officer*

Q. TODD DICKINSON

*Director of Patents and Trademarks*